US005354022A

United States Patent [19]

Coonrod

[11] Patent Number: 5,354,022

[45] Date of Patent: Oct. 11, 1994

[54] PATIENT ASSISTANT DEVICE

[76] Inventor: Betty J. Coonrod, 8317 Spring Valley Rd., Belton, Mo. 64012

[21] Appl. No.: 5,629

[22] Filed: Jan. 19, 1993

[51] Int. Cl.[5] ..... A45A 19/04

[52] U.S. Cl. ..... 248/127; 5/658; 5/662; 297/DIG. 10

[58] Field of Search ..... 248/127; 5/2.1, 662, 5/503.1, 658; 297/DIG. 10, 5

[56] References Cited

U.S. PATENT DOCUMENTS

| | | | |
|---|---|---|---|
| 4,373,222 | 2/1983 | Wolfe | 5/662 X |
| 4,564,164 | 1/1986 | Allen | 5/658 X |
| 4,624,245 | 11/1986 | Mullin | 5/658 X |
| 4,932,090 | 6/1990 | Johansson | 5/658 |
| 5,086,798 | 2/1992 | Motts | 297/5 X |
| 5,149,036 | 9/1992 | Sheehan | 5/658 X |
| 5,226,439 | 7/1993 | O'Keefe | 297/DIG. 10 |
| 5,231,721 | 8/1993 | Fish | 5/662 |
| 5,257,426 | 11/1993 | Leoutsakos | 5/503.1 |

*Primary Examiner*—J. Franklin Foss

*Attorney, Agent, or Firm*—Hovey, Williams, Timmons & Collins

[57] ABSTRACT

A patient assistant device is provided which includes a base, an upright support and a handrail. The base is configured and sized so that a patient's feet are supported thereon during transition from a sitting to a standing position. The device preferably includes a plurality of upright supports and rails, with the rails positioned to allow the patient to stand up and hold on to one or both rails before moving away with the assistance of a cane, walker or the like. The device hereof also includes a coupling member for connecting the device in fixed relationship to a bed, chair or other article of furniture.

24 Claims, 1 Drawing Sheet

PATIENT ASSISTANT DEVICE

BACKGROUND OF THE INVENTION

1. Field of the Invention

This application concerns a device for assisting patients during movement from a sitting or reclining position to a stance for walking. More particularly, it is concerned with a device which can be fixed relative to a bed, chair or like piece of furniture and provide a ready handrail for grasping by the patient.

2. Description of the Prior Art

A variety of devices have been developed to allow medical patients or the elderly to walk with support. Devices such as crutches, canes and so-called walkers are well-known, the latter typically being advanced step by step in front of the user and including four legs and one or more cross-rails for grasping. Because of the need for portability, all of these devices are lightweight and limited in the amount of stability they can provide.

However, elderly or infirm individuals, as well as those patients suffering from a hip, knee, leg or foot injury, often face severe difficulty in moving between a standing position and a reclining or seated position. The patient would typically like to use his or her arm to provide strength and stability to attain a stance, but often this proves impossible because of the absence of any sort of support. For example, the patient may try to push off the bed or chair, but fails to achieve sufficient height to stand. Even if a stance is attained, the fear of falling due to any available stable support may prove frightening. The patient's cane or walker may simply be too unstable during the transition from the sitting to the standing position.

There is thus a real need for a patient assist device which can be used with beds or chairs for allowing a patient to use his or her hands for support during the transition from the sitting to the standing position. In addition, such a device will preferably be stable, yet avoid the necessity for bolting or other permanent affixation to the structure. Furthermore, there is a need for a patient assist device which will allow the patient to move easily and without difficulty to access his or her mobility support such as a crutch, cane or walker.

SUMMARY OF THE INVENTION

These objects are in large measure resolved by the patient support device in accordance with the present invention. That is to say, the device hereof provides a ready handrail which can be positioned close to a bed or chair, is stable, requires no structural modifications and allows the patient to readily acquire and use a mobility support.

Broadly speaking, the present invention includes a base, at least one upright support connected to the base, and a handrail. The base is preferably of a size sufficient to enable the patient to stand thereon. This enables the patient's weight to increase the stability of the device hereof without the necessity of excess weight which could make positioning of the device difficult or fasteners to secure the base to the floor therebeneath. The upright support is preferably provided with a coupling member to securely connect the device to a piece of furniture. For example, the coupling member hereof can be connected to a bed railing to more readily and reliably fix the position of the handrail relative thereto.

In particularly preferred embodiments, a plurality of upright supports may be provided, with a transition rail connected to the supports and oriented angularly relative to the handrail. The transition rail is preferably lower than the handrail to provide additional assistance to a patient during transition from a sitting to a standing position. The transition rail and the handrail are preferably oriented in an L-shaped pattern along the edges of the base whereby the patient may place his or her feet on the base while grasping one or both of the transition rail and handrail. The base is preferably covered with a skid-resistant covering such as carpet and a toe bar is provided along the edge of the base opposite the normal sitting position of the user to limit the possibility of a slip and fall.

DESCRIPTION OF THE PREFERRED EMBODIMENT

Figures 1, 2, 3, 4, 5, 6, 7, 8, 9:
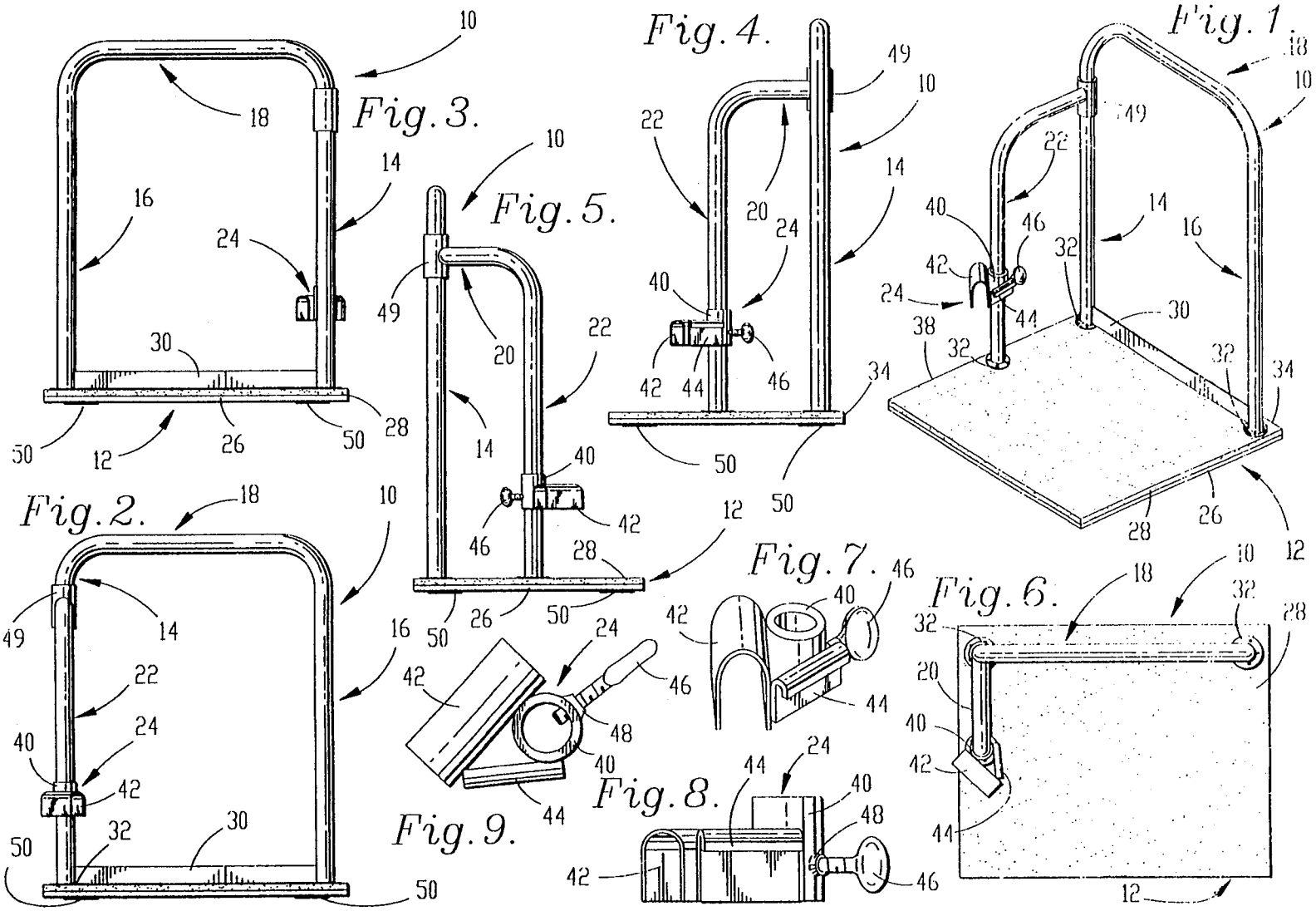
FIG. 1 is a perspective view of the present invention showing the base, upright supports, rails and coupling member.
FIG. 2 is a front elevational view thereof.
FIG. 3 is a rear elevational view thereof.
FIG. 4 is a right side elevational view thereof.
FIG. 5 is a left side elevational view thereof.
FIG. 6 is a top plan view thereof.
FIG. 7 is an enlarged perspective view showing the coupling member.
FIG. 8 is an enlarged elevational view thereof.
FIG. 9 is a top plan view thereof.

Referring now to the drawing, the preferred embodiment of a patient assistant device 10 broadly includes a base 12, first upright support 14, second upright support 16, handrail 18 connecting first and second upright supports 14 and 16, transition rail 20, transition support 22, and coupling member 24. Transition rail 20 extends from transition support 22 and is welded to sleeve 49, which slip fits over first upright support 14 whereby transition rail 20 extends substantially perpendicular to both the upright support 14 and handrail 18.

in greater detail, base 12 includes a panel 26 which is preferably of a heavy material such as ¾" plywood. The base is preferably large enough to accommodate a standing patient, and a particularly preferred base would measure at least 24 inches by 32 inches. A layer 28 of slip-resistant padding or carpeting covers the top of the panel 26 to provide a slip-resistant surface on which to stand as well as some thermal insulation value. Four sponge rubber pads 50, are mounted on the bottom of base 12 to prevent device 10 from slipping on smooth floors. A toe bar 30 of stainless steel or the like is connected to the bottom of both the first upright support 14 and second upright support 16 adjacent the base 12 to inhibit a patient's foot from moving therepast which could occur during in an inadvertent slip.

Upright supports 14 and 16 are preferably formed of stainless steel tubing sufficient to provide an adequate and stable support for handrail 18. 1½ O.D. stainless steel tubing has proven adequate for this purpose. The upright supports 14 and 16 are preferably about 36" in height for most residential applications to provide for ease of grasping during use. The upright supports 14 and 16, as well as transition support 22, are connected to base 12 by footings 32 which are provided with a circumscribing flange presenting a plurality of openings for receiving screws as is well known in the art. Handrail 18 is essentially a continuation of upright supports 14 and 16 but is preferably level and horizontal as is shown in the drawing. As may be seen in FIGS. 1,2, 3, 4, and 5, as upright supports 14 and 16 continue into handrail 18 and transition support 22 continues into transition handrail 20, all of the edges are rounded to avoid any sharp corners which might be more likely to injure a frail and stumbling patient.

While upright supports 14 and 16 are adjacent the remote edge 34 of base 12 and opposite the intended sitting position of the patient, transition support 22 is positioned closer to the proximate edge 36 of the base 12 and adjacent the entry end 38 of the base 12 so that a transition rail 20, which is a continuation of transition support 22 is oriented perpendicular to both first upright support 14 and handrail 18. Transition rail 20 is welded to sleeve 49 which is slip fitted over upright support 14. The sleever 49 allows the transition rail to be rotated 180 degrees to provide for right or left hand use.

Coupling member 24 includes a collar 40 which permits the coupling member to be selectively positioned along transition support 22. The coupling member 24 also includes a pair of differently sized, inverted U-shaped clips 42 and 44. The clips 42 and 44 are angularly oriented whereby one or the other, as appropriate, may be attached to a patient supporting member such as a bed, chair, or the like. For example, clip 42 presents a deeper bight suitable for attachment to an arcuated surfaced member while clip 44 has a shallower bight suitable for attachment to a flat member. Thumbscrew 46 is inserted into a threaded receiver 48 on collar 40 to permit locking of the coupling member 24 at a selected height along transition support 22, and also to present the appropriate clip 42 or 44 to the rail of a bed or other receiving member of the patient supporting member.

In use, patient assistant device 10 hereof is preferably positioned in close proximity to the patient supporting member such as a bed. In this way, coupling member 24 may be adjusted so that the appropriate clip 42 or 44 may be attached to the bedframe or the like so as to position the device 10 relative to the patient supporting member. Thus, the patient may sit with his or her feet over the side of the bed and grasp the handrail 18 and/or, when appropriate, the transition rail 20. When ready, the patient places his feet on the base 12. The additional weight helps to stabilize the device 10. The slip-resistant covering 28 and the toe bar 30 help to inhibit any fall or slip which might otherwise occur.

To stand up, patient may use his arms to push upwardly while grasping transition rail 20 and his or her legs until pushed to a standing or partially upright position. As the weight transfers to the patient's legs, the stability of the device 10 is enhanced. Patient may also grasp handrail 18 until he or she stands fully erect. The base 12 is dimensioned of sufficient width not only to support the standing patient, but also to allow the patient to advance between the bed and the handrail in a direction away from entry edge 38. The patient may then use his or her crutches, cane or walker having achieved a stance with the aid of the device 10 hereof. The foregoing steps may be reversed if the patient moves to a sitting position on a bed located next to the device.

The device 10 hereof may also be advantageously used in connection with a chair or the like. The chair may be positioned on the base 12 with the chair facing handrail 18 and toe bar 30. The weight of the patient thus remains on the base 12 both before and during the transition to a standing position. This provides significant stability for the device 10 without the need for permanent attachment to a floor. When so used, patient may grasp the transition rail 20 and/or the handrail 18 as described herein above in order to push upwardly to a standing position.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states her intent to rely on the Doctrine of Equivalents to determine and assess the reasonably fair scope of her invention as pertains to any apparatus not materially departing from but outside the liberal scope of the invention as set out in the following claims.

I claim:

1. A patient assist apparatus for assisting movement of a patient to or from an article of furniture such as a bed or chair, the article of furniture presenting an access edge, said apparatus comprising:

a base; and a patient support structure coupled with said base including a substantially horizontal handrail spaced above said base, said base presenting a support section adjacent said handrail, said support section of said base presenting opposed side portions, said base and support structure being configured to cooperate with the article of furniture to present said handrail spaced therefrom and substantially parallel to the edge of the article of furniture with said support section of said base therebetween for allowing the patient to grasp said handrail while standing on said support section, at least one of said side portions of said base and the space thereabove being devoid of structure for allowing entry to and exit from said support section and thereby the article of furniture.

2. The apparatus as set forth in claim 1 further including means for coupling with the article of furniture for preventing movement of said apparatus relative to the article of furniture.

3. The apparatus as set forth in claim 1, said base including an additional section adjacent said support section for supporting at least a portion of the article of furniture thereon whereby the weight of the article of furniture prevents relative movement between said apparatus and the article of furniture.

4. The apparatus as set forth in claim 1, said base being composed of plywood.

5. The apparatus as set forth in claim 1, said base presenting top and bottom surfaces, said base including a slip resistant coating on said top surface and slip resistant pads on said bottom surface.

6. The apparatus as set forth in claim 1, said patient support structure further including a pair of spaced upright legs with said handrail extending therebetween, said legs and handrail being integrally formed of tubing.

7. The apparatus as set forth in claim 6, said tubing being composed of stainless steel.

8. The apparatus as set forth in claim 6, further including a toe bar extending between said legs adjacent said base.

9. The apparatus as set forth in claim 1 further including a second support structure coupled with said base adjacent one of said side portions, said base including forward and rearward portions on opposed sides of said support section, said second support structure including a third upright leg located about midway between said forward and rearward portions and including a support rail having one end coupled with said third leg and having an opposed end releasably coupled with said patient support structure.

10. The apparatus as set forth in claim 9 further including means for coupling said second support structure with the article of furniture.

11. A patient assist device for assisting movement of a patient to or from an article of furniture such as a bed or chair, the article of furniture presenting an access edge, said device comprising:

a base presenting opposed forward and rearward portions and opposed side portions with said portions defining a central section of said base;

a first support structure coupled with said base adjacent said forward portion, said first support structure including first and second, spaced, upright legs and a substantially horizontal handrail the therebetween; and a second support structure coupled with said base adjacent one of said side portions, said second support structure including a third upright leg located about midway between said forward and rearward portions and rearward of one of said first and second legs, and a support rail having one end coupled with said third leg and having an opposed end releasably coupled with said one of said first and second legs, said first and second support structures being releasably coupled with said base for allowing said first support structure to be shifted to a location adjacent said rearward edge while said third support leg remains located about midway between said forward and rearward edges, said base and support structures being configured to cooperate with the article of furniture to present said handrail spaced therefrom and substantially parallel to the edge of the article of furniture with at least of a portion of said central section therebetween and with said second support structure between the article of furniture and said handrail for allowing the patient to grasp said handrail while standing on said central section, the other of said side portions being devoid of structure in the vicinity thereof for allowing entry to and exit from said central section by way of said other of said side portions.

12. The apparatus as set forth in claim 11 further including means for coupling with the article of furniture for preventing movement of said apparatus relative to the article of furniture.

13. The apparatus as set forth in claim 12, said coupling means including means for coupling said third leg with the article of furniture.

14. The apparatus as set forth in claim 13, said coupling including a clip for coupling with the frame of a bed.

15. The apparatus as set forth in claim 11, said base including an additional section rearward of said central section for supporting at least a portion of the article of furniture thereon whereby the weight of the article of furniture prevents relative movement between said apparatus and the article of furniture.

16. The apparatus as set forth in claim 11, said base being composed of plywood.

17. The apparatus as set forth in claim 11, said base presenting top and bottom surfaces, said base including a slip resistant coating on said top surface and slip resistant pads on said bottom surface.

18. The apparatus as set forth in claim 11, said first and second legs and said handrail being integrally formed of tubing.

19. The apparatus as set forth in claim 18, said tubing being composed of stainless steel.

20. The apparatus as set forth in claim 11, said third leg and support rail being integrally formed of tubing.

21. The apparatus as set forth in claim 20, said tubing being composed of stainless steel.

22. The apparatus as set forth in claim 11, further including a toe bar extending between said first and second legs adjacent said base.

23. The apparatus as set forth in claim 11 further including means for coupling said second support structure with the article of furniture.

24. The apparatus as set forth in claim 23, said coupling means including a clip for coupling said third leg with the frame of a bed.

* * * * *